US007021210B2

(12) United States Patent
Elliott et al.

(10) Patent No.: US 7,021,210 B2
(45) Date of Patent: Apr. 4, 2006

(54) PRINTING PRESS CYLINDER

(75) Inventors: James A. Elliott, Euless, TX (US); Howard W. DeMoore, Dallas, TX (US); Howard C. Secor, Krum, TX (US); Charles G. Kelly, Garland, TX (US)

(73) Assignee: Printing Research, Inc., Dallas, TX (US)

( * ) Notice: Subject to any disclaimer, the term of this patent is extended or adjusted under 35 U.S.C. 154(b) by 31 days.

(21) Appl. No.: 10/805,886

(22) Filed: Mar. 22, 2004

(65) Prior Publication Data

US 2005/0204940 A1 Sep. 22, 2005

(51) Int. Cl.
*B41F 27/06* (2006.01)

(52) U.S. Cl. ..... 101/378; 101/375

(58) Field of Classification Search ..... 101/216, 101/483, 378, 375, 212, 416.1, 417–420
See application file for complete search history.

(56) References Cited

U.S. PATENT DOCUMENTS 4,237,786 A * 12/1980 Sanford ..... 101/378
4,694,750 A * 9/1987 Greene ..... 101/483
4,967,656 A 11/1990 Douglas et al. ..... 101/142
4,967,661 A * 11/1990 Duarte ..... 101/420
5,046,421 A * 9/1991 DeMoore ..... 101/420
5,312,488 A * 5/1994 Bolza-Schunemann et al. ..... 118/205
5,415,098 A 5/1995 Ward ..... 101/493
D367,670 S 3/1996 Elliott ..... D18/58
5,915,305 A 6/1999 Ward et al. ..... 101/416.1

* cited by examiner

*Primary Examiner*—Anthony H. Nguyen
(74) *Attorney, Agent, or Firm*—Conley Rose, P.C.

(57) ABSTRACT

A multipart printing press cylinder. A pair of hubs have an inner bore for mounting on a press shaft. Each hub is made in two parts which may be positioned about the press shaft and attached to each other by, e.g. screws. Each hub has a profile section. A pair of partial shells each include a pair of cylinder frames having a profile matching a hub profile. Manually releasable latches are provided for holding each partial shell on the hubs when the partial shell profiles are mated with the hub profiles. The outer perimeter of each cylinder frame has a radius and contour defining the outer size and shape of a printing press cylinder. A surface material, e.g. sheet aluminum, is formed to fit the frame perimeters and are preferably attached under tension to the frames.

20 Claims, 10 Drawing Sheets

PRINTING PRESS CYLINDER

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to cylinders for printing presses and more particularly to a multiple part cylinder which may be quickly and easily installed in and removed from a printing press.

BACKGROUND OF THE INVENTION

In the operation of a multi-color rotary offset printing press, freshly printed substrates such as sheets or web material may be guided by various cylinders from one printing unit to another, and then they are delivered to a sheet stacker or to a sheet folder/cutter unit, respectively. The cylinders are known by various names including transfer cylinders, delivery cylinders, transfer rollers, support rollers, delivery wheels, skeleton wheels, segmented wheels, transfer drums, support drums, spider wheels, support wheels, guide wheels, guide rollers, etc.

The cylinders may be installed in and removed from printing presses at various times and for various reasons. Printing presses are often built and delivered without transfer and/or delivery cylinders. Such cylinders are normally installed before operating the presses. However, printing presses often have structural cross members, such as tie bars, which must be removed to provide sufficient space to install a cylinder. Removal and replacement of the cross members takes a considerable amount of time and may require the services of a professional press mechanic. Once installed, a transfer cylinder often blocks access to a back cylinder, e.g. an impression cylinder, which needs to be cleaned or maintained on a regular basis, for example daily. While various special cleaning devices have been devised to reach around or over a transfer cylinder to clean the back cylinders, cleaning is much easier if the transfer cylinder is removed. Various types of printing jobs may require transfer cylinders of different diameters. But, as noted above, removal and/or replacement of a cylinder often requires removal and replacement of cross members.

SUMMARY OF THE INVENTION

The present invention provides a printing press cylinder including a pair of hubs for installation on a press shaft and two or more partial cylinder shells. Each hub and partial shell has a mounting profile by which the partial shells may engage the hubs. Manually operable latches, preferably spring loaded, are provided for releasably attaching each partial shell to the hubs.

In one embodiment, mating profiles of the partial shells and hubs are shaped so that each partial shell fits in only one position on the hubs. In this embodiment, nonsymmetrical cylinders cannot be installed improperly.

DETAILED DESCRIPTION OF THE PREFERRED EMBODIMENTS

Figure 1:
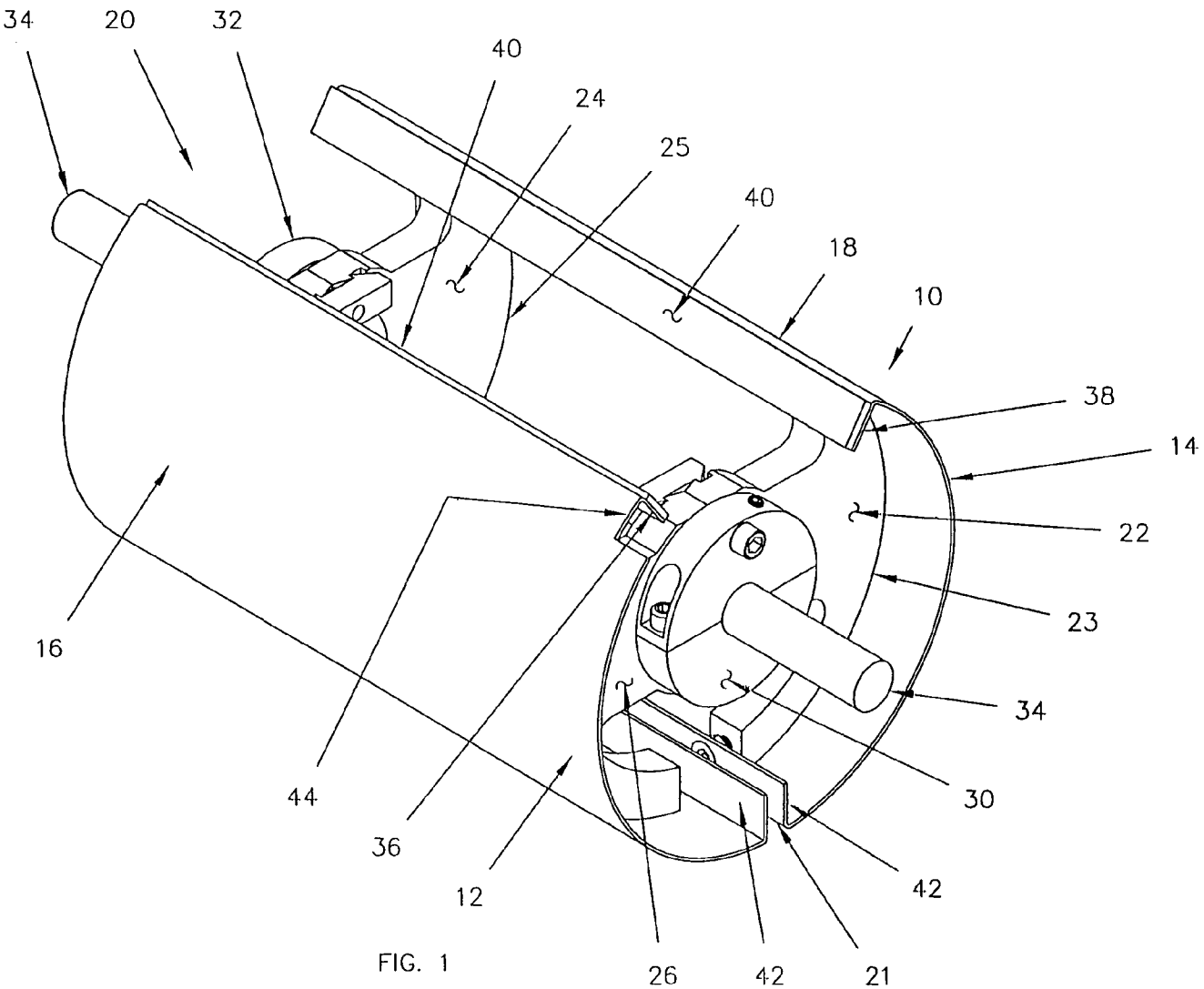
FIG. 1 is a perspective view of a first embodiment of a quick release cylinder assembled on a printing press shaft.

FIG. 1 provides a perspective view of a first embodiment of a quick release cylinder 10 according to the present invention. More detailed descriptions of the various elements of the cylinder 10 are described with reference to FIGS. 2 through 5. The cylinder 10 includes two partial shells 12 and 14. The outer surfaces or skins 16 and 18 of partial shells 12 and 14 may be formed from flexible sheets of a material which may be formed into partial cylinder shapes. The skins 16, 18 may be formed from sheet metal, e.g. aluminum, or other suitable material. The partial shells 12 and 14 each form less than one half of the circumference of a complete cylinder. As is typical of printing press transfer cylinders, a fairly wide separation 20 is provided between the partial shells 12 and 14 on one side to provide space for grippers. The separation 20 also conveniently provides access for manual installation and removal of the cylinder 10 as described in detail below. On the opposite side of the cylinder 10 is a small separation 21 between the partial shells 12 and 14. Separation 21 is preferably small, but is large enough to allow assembly of the partial shells in a press.

The outer skin 18 of the partial shell 14 is carried on a pair of cylinder frames 22 and 24 having generally circular outer edges 23 and 25 supporting and providing a desired generally cylindrical shape to the sheet 18. The outer skin 16 of the partial shell 12 is carried on a pair of cylinder frames 26 and 28, (frame 28 is hidden in FIG. 1), having generally circular outer edges supporting and providing a desired generally cylindrical shape to the sheet 16. Each of the cylinder frames 22, 24, 26 and 28 have inner profiles sized and shaped to engage profiles on a pair of hubs 30 and 32 carried on a printing press rotating shaft 34. The mating profiles insure that the partial shells 12 and 14 are positioned properly relative to the hubs 30 and 32 and therefore relative to the shaft 34. The cylinder frames 22, 24, 26 and 28 and the hubs 30 and 32 may be may be machined from a structural material, e.g. one-half inch thick aluminum slab stock, or may be cast or molded from an appropriate material, e.g. aluminum, structural plastic, etc.

The skins 16 and 18 have inward turned flanges 36 and 38 forming a gripper edge and a tail edge respectively on opposite sides of the separation 20. In one embodiment, an attachment strip 40, e.g. a hook and loop system such as VELCRO, is carried on each flange 36, 38 for attaching a cylinder base cover and/or jacket to the cylinder 10. Other releasable attachment means, e.g. spring loaded clamps, hooks, snaps, etc., may be provided on the flanges 36, 38 if desired. The skins 16 and 18 also have inward turned flanges 42 on opposite sides of the separation 21. The inward turned flanges 36, 38, and 42 are used to attach the skins 16 and 18 to the cylinder frames 22, 24, 26 and 28.

In some presses, the partial shells 12 and 14 could have identical exterior dimensions and could therefore be interchangeable. In this embodiment, the partial shell 12 includes a cam cut 44 in the skin 16 and flange 38 providing space for a cam mechanism which operates a gripper bar. In some embodiments, the outer surface of the cylinder 10 is intentionally eccentric or otherwise not truly cylindrical. See for example U.S. Pat. No. 4,967,656. For example, in some cases it is desirable for the cylinder radius at the gripper edge 36 to be different from the radius at the tail edge 38. Thus in many cases, the partial shells 12 and 14 do not have precisely cylindrical outer surfaces and are not interchangeable. In this embodiment, the mating profiles of the cylinder frames 22, 24, 26 and 28 and hubs 30 and 32 are shaped to allow installation of each cylinder partial shell 12 and 14 on only one side of the hubs 30, 32.

Figure 2:
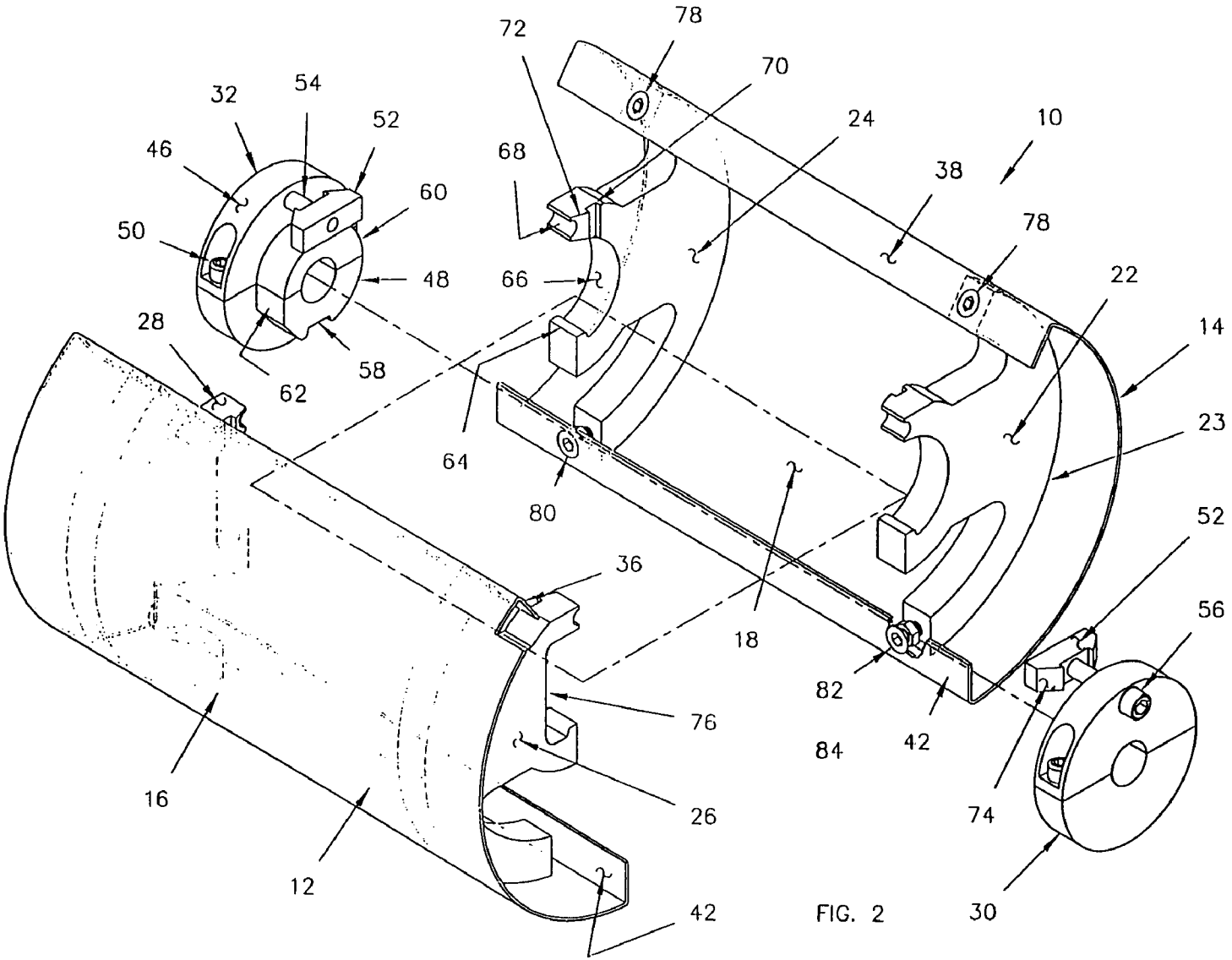
FIG. 2 is an exploded view of the cylinder of FIG. 1.

FIG. 2 provides an exploded view of the cylinder 10 of FIG. 1. More details of the mating profiles of cylinder frames 22, 24, 26, 28 and the hubs 30, 32 are shown. The basic elements of the profiles will be described with reference to cylinder frame 24 and hub 32 in its assembled form. The hub 32 includes a circular section 46 and a profile section 48. The hub 32 is also split into upper and lower half portions connected by screws 50 as shown in more detail in FIG. 3. A latch 52 is carried on a spring-loaded rod 54 extending over the profile section 48. As shown on the hub 30, a portion of rod 54 extends from the hub 32 to form a push button 56 which may be manually depressed to move the latch 52 away from the circular section 46. Alternatively, the latch 52 itself may be manually pulled away from the circular section 46. In one embodiment, the latch may be pulled and rotated a quarter turn, e.g. when removing partial shells, to stay in an open, i.e. non-latching, position. The profile 48 includes on its lower edge a slot 58 defined by two shoulders. On one side 60, the profile 48 is circular and on an opposite side 62 the profile includes a flat spot.

The cylinder frame 24 includes an inner profile shaped to mate with the slot 58, circular portion 60, the rod 54, and the latch 52. This profile includes a dog 64 for fitting into one side of slot 58, a circular profile 66 fitting circular portion 60, and an axial circular profile 68 fitting the rod 54. The cylinder frame 24 also includes a notch 70 for engaging one side of the latch 52. The frame 24 includes an angled surface 72 matching an angled surface 74 (see hub 30) on latch 52, so that the latch 52 can be opened to receive the frame 24 by pressing the partial shell 14 onto the hub 32.

The mating profiles on cylinder frame 22 and hub 30 are essentially identical to those described for frame 24 and hub 32. The only difference is that the hub 30 is a mirror image of hub 32 and the frame 22 is a mirror image of frame 24.

The cylinder frames 26 and 28 of the partial shell 12 are likewise very similar to the frames 22 and 24. With reference to frame 26, it can be seen that the primary difference is a flat profile section 76 designed to mate with flat profile 62 on the hubs 30 and 32. The circular profiles 66 on frames 22 and 24 and the flat profiles 76 on the frames 26 and 28 prevent installation of the partial shells 12 and 14 on the wrong sides of the hubs 30 and 32.

FIG. 2 also illustrates the connection of the partial shell skins 16 and 18 to the cylinder frames 22, 24, 26 and 28. This connection is best illustrated with respect to the attachment of skin 18 to the frames 22 and 24. Two screws 78 are provided through the flange 38 and threaded into the frames 22 and 24 to hold one edge of the skin 18 in place on the frames. These screws are not visible in FIG. 1, because they are covered by the cover attachment strips 40. On the opposite edge of skin 18, two jackscrews 80 and 82 are positioned through the flange 42 and threaded into the frames 22 and 24. The cutaway portion of flange 42 exposes the jackscrew 82, which includes a nut 84. The nut 84 may be threaded up the shaft of screw 82, i.e. away from the frame 22, to apply tension to the skin 18 and pull it into contact with the frame 22 around its outer circumference 23. The nut 84 may then be held in place with a wrench as the screw 82 is tightened to complete the attachment of the sheet 18 to the frame 22. This same jackscrew assembly technique is preferably used on the other three attachment locations on flanges 42. This assembly arrangement avoids having any fasteners on or through the sheet supporting surfaces of the cylinder 10. It also allows the outer contour of the cylinder 10 to be selected by the shape of the outer edges of the cylinder frames 22, 24, 26 and 28 which may be precisely machined or cast.

Figure 3:
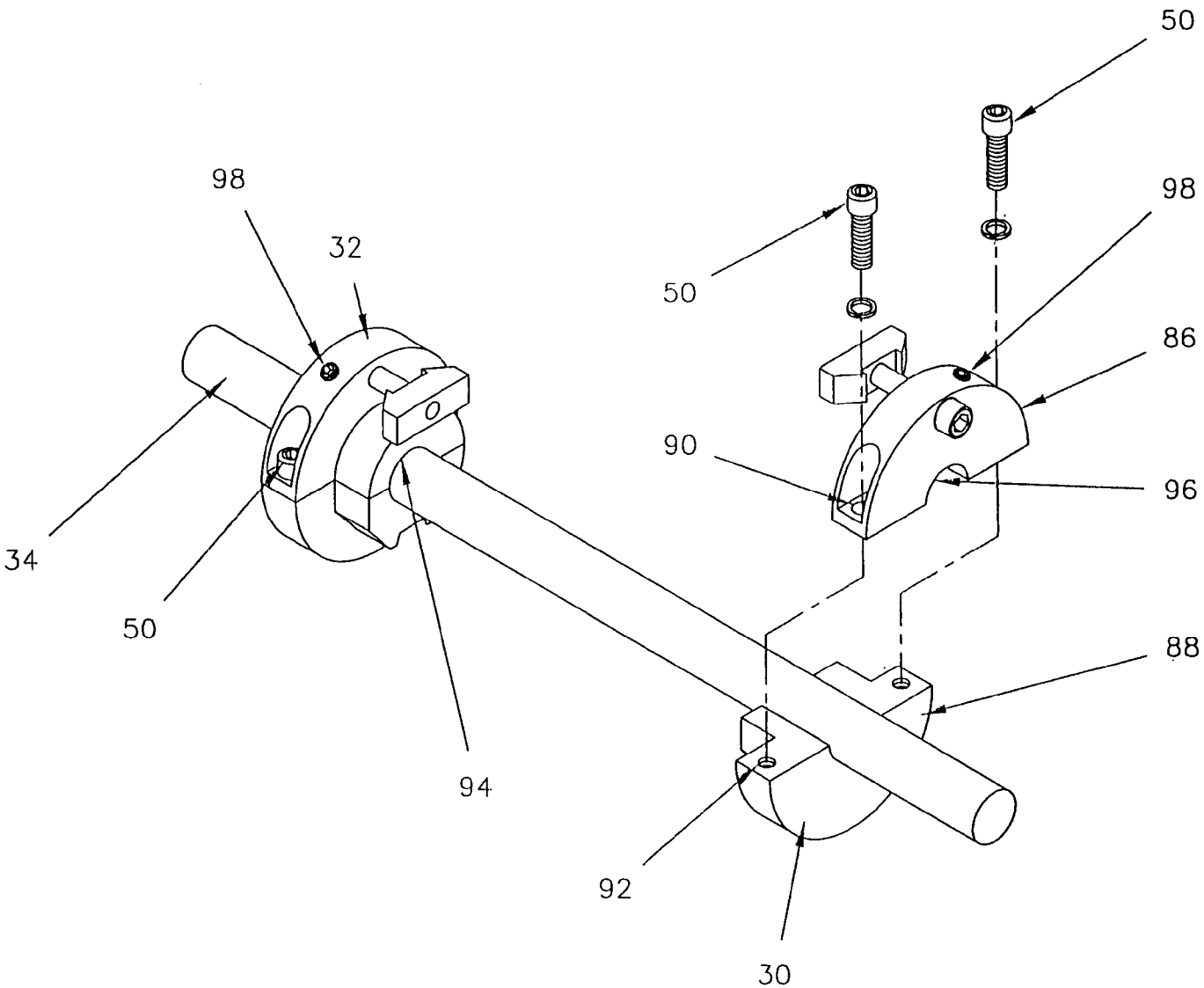
FIG. 3 is a perspective view of one cylinder hub of the first embodiment installed on a press shaft and an exploded view of a second cylinder hub illustrating installation of the cylinder hubs on a press shaft.

FIG. 3 illustrates more details of the hubs 30 and 32 and the assembly of the hubs to a press shaft 34. The exploded view of hub 30 illustrates its upper portion 86 and lower portion 88. Clearance holes 90 are provided through the upper portion 86 and threaded holes 92 are provided in the lower portion 88. Screws 50 are placed through the holes 90 and threaded into the holes 92 to attach the upper portion 86 to the lower portion 88. Central bores 94 and 96 are provided through hubs 30 and 32 for receiving the press shaft 34.

In one embodiment, the bore 94 may be sized to form an interference fit on the shaft 34 when the screws 50 are tightened while bore 96 is sized to form a movable friction fit to the shaft 34. For purposes of this invention, having an interference fit means that after tightening the screws 50, the hub 32 cannot be moved relative to the shaft 34 except by application of forces which would damage the hub 32 and/or the shaft 34. Having a movable friction fit means that after tightening the screws 50, the hub 30 may be moved relative to the shaft 34 by application of reasonable manual force without damaging the hub 30 or the shaft 34. In this embodiment, the hub 32 may be tightened onto the shaft 34 at an appropriate position relative, for example, to a sprocket wheel carried on the shaft 34. The hub 30 may then be tightened onto the hub 34 at an appropriate position relative to the hub 32. When attempting to install a first partial shell onto the hubs 30, 32, it may be determined that the hub 30 is not positioned properly. The friction fit of hub 30 allows its position to be manually adjusted while attaching a first partial shell to the hubs. After the hubs 30 and 32 are properly positioned, setscrews 98 may be tightened to prevent any movement of the hubs 30, 32 relative to the shaft 34.

In some embodiments, the shaft 34 and hubs 30 and/or 32 may have keyways and keys may be used to prevent relative rotation between the shaft 34 and hubs 30 and/or 32. For maximum flexibility in positioning of the assembled cylinder 10 on the shaft 34, a preferred embodiment is for both hubs 30, 32 to have bores 96 and 94 sized to provide a movable friction fit when the screws 50 are fully tightened and to lock the hubs 30, 32 in position with the set screws 98.

Figure 4:
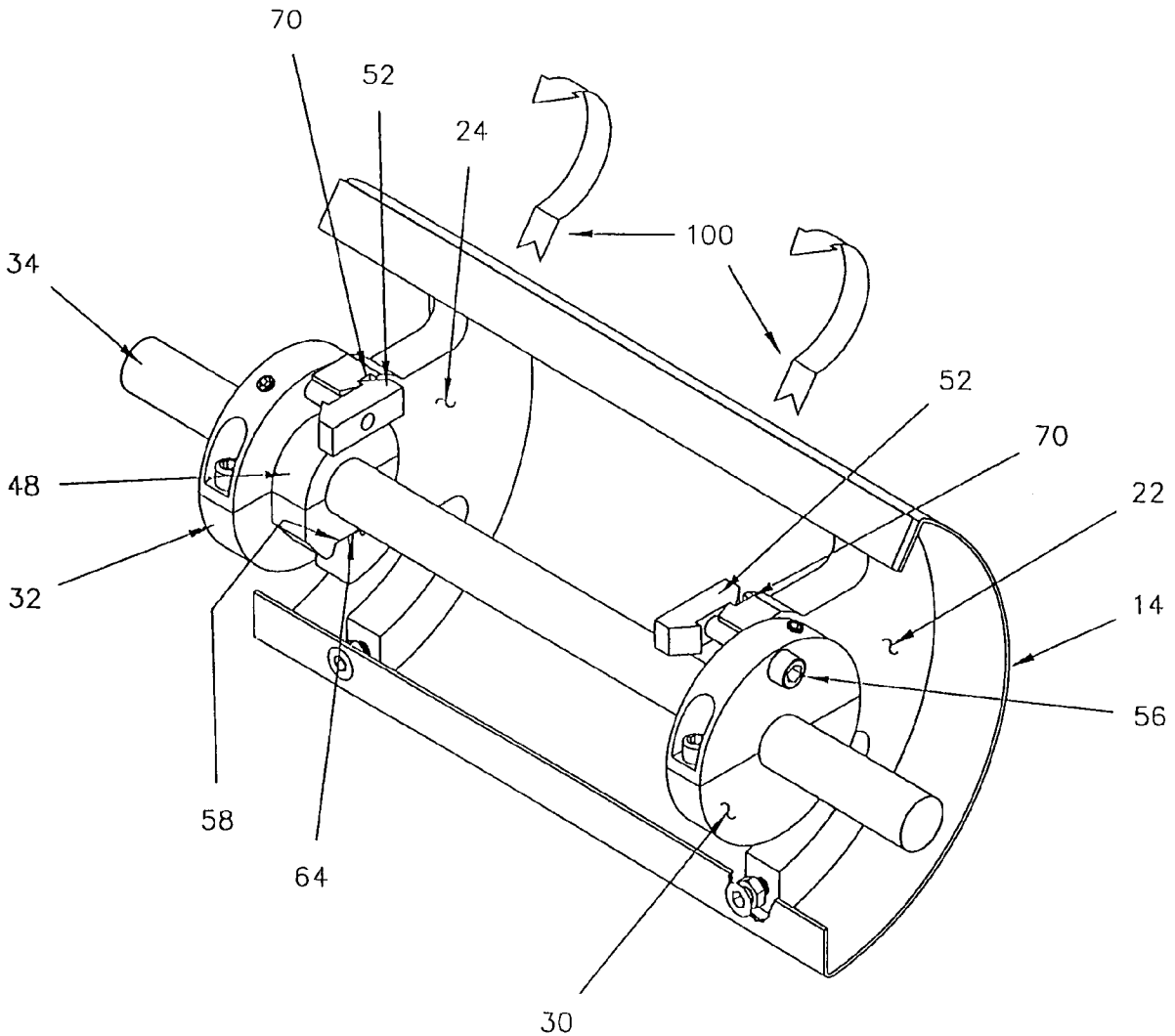
FIG. 4 is an illustration of a method of assembly of one partial shell of the first embodiment to hubs on a printing press shaft.

FIG. 4 illustrates the assembly of partial shell 14 onto the hubs 30 and 32 after the hubs have been attached to the printing press shaft 34. As indicated by the arrows 100, the partial shell 14 is lifted so that the dogs 64 engage the slots 58 on the bottom of the profiled portion 48 of the hubs 30 and 32. The partial shell 14 is then pivoted about the contact point of the dogs 64 with the hubs 30, 32 until the notches 70 engage the latch 52. As noted above, the slanted surfaces 72, 74 operate to open the latch 52 as the partial shell 14 is tilted into place, without need to press the push buttons 56 or pull on the latch 52 to open the latch. When the latches 52 snap into the notches 70, the partial shell 14 is positively attached to the hubs 30 and 32. The partial shell 14 can be easily released by pressing both of the push buttons 56 to open the latches 52 or by pulling the latches themselves.

Figure 5:
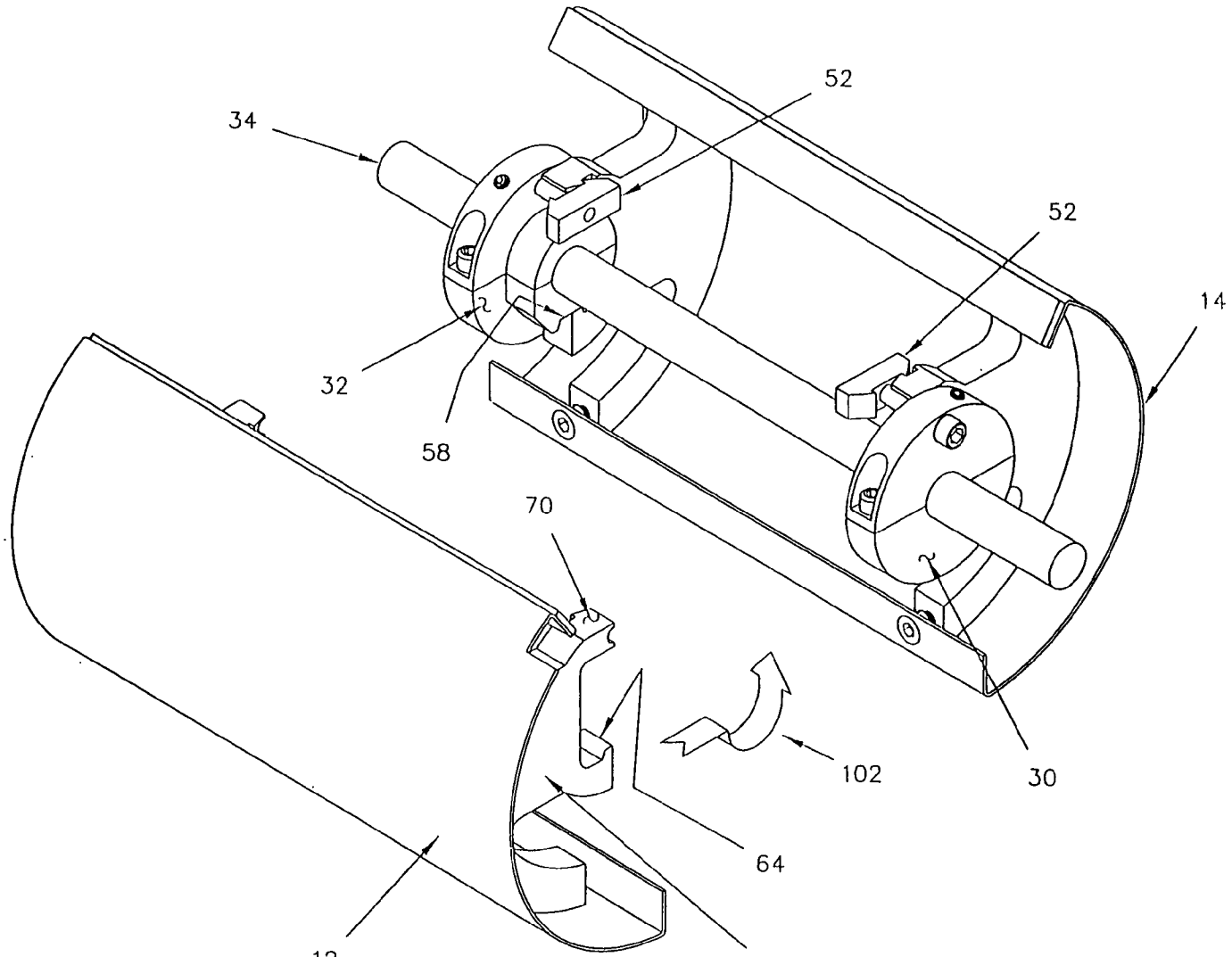
FIG. 5 is an illustration of a method of assembly of a second partial shell of the first embodiment onto the hubs on a printing press shaft.

FIG. 5 illustrates the attachment of the partial shell 12 to the hubs 30 and 32 after the partial shell 14 has been attached. As indicated by the arrow 102, the partial shell 12 is attached in essentially the same way that the partial shell 14 was attached. The partial shell 12 is tilted and lifted so that the dogs 64 engage the slots 58 on the bottom of each profiled half 48 of the hubs 30, 32. The top of the partial shell 12 is then tilted toward the hubs 30, 32 until the notches 70 engage the latches 52. When both partial shells 12 and 14 are engaged by the latches 52, the complete cylinder assembly 10 of FIG. 1 is achieved. The assembly can be quickly released by pressing the push buttons 56 which opens the latches 56 or pulling the latches 52 and allows both partial shells 12 and 14 to be tilted away from the hubs 30, 32 and removed from the press. When removing the partial shells 12 and 14, it may be desirable to also rotate the latches 52 a quarter turn to prevent the partial shells 12 and 14 from accidentally becoming relatched to one or both of the hubs 30, 32.

Figure 6:
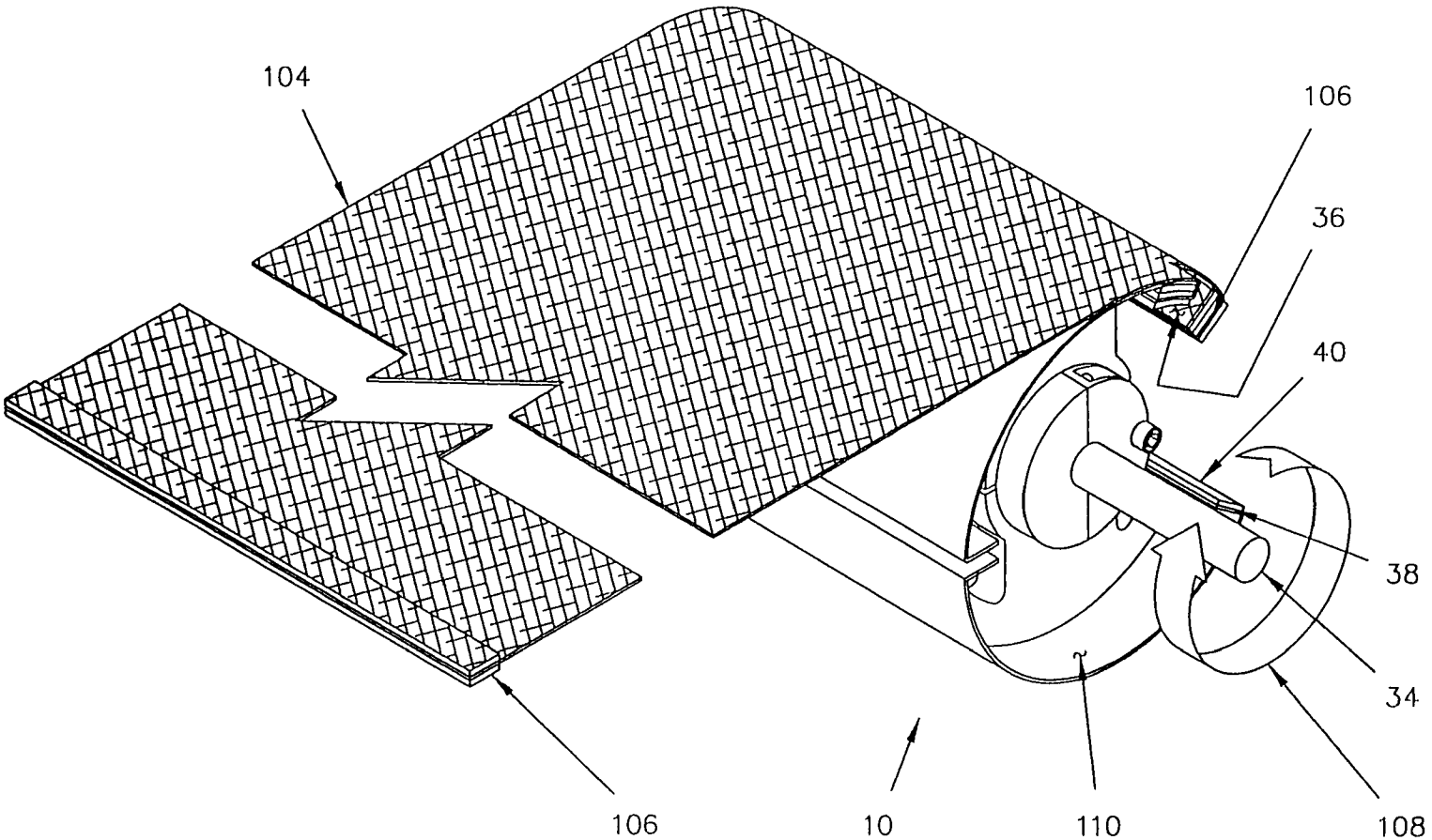
FIG. 6 is an illustration of installation of a cylinder covering onto the cylinder of the first embodiment.

FIG. 6 illustrates the attachment of a cylinder cover 104 onto a completed cylinder 10 of the first embodiment. The cover 104 may be a base covering or a combined base covering and flexible jacket as disclosed in copending U.S. patent application Ser. No. 10/083,785, filed Feb. 25, 2002, entitled "Inexpensive, Wash-Free Integrated Cover for Printing Press Transfer Cylinder", which is hereby incorporated by reference for all purposes. The cover 104 includes attachment strips 106 at least along two sides sized and spaced to mate with the attachment strips 40 on the gripper and tail edges 36 and 38 of the cylinder 10. One attachment strip 106 of the cover 104 is shown pressed onto the gripper edge 36 of the cylinder 10. As indicated by the arrow 108, the shaft 34 may then be rotated to wrap the cover 104 around the cylinder 10. When the cover 104 is fully wrapped around the cylinder 10, the other attachment strip may be pressed onto the attachment strip 40 on the tail edge 38 of the cylinder 10. In some embodiments, additional attachment strips like strips 40 may be attached to the inner surface of the cylinder skins 16 and 18 along the outer edges, e.g. at 110. Some jacket coverings may be attached directly to the attachment strips along all four sides of the cylinder 10.

As noted above, a problem with prior art transfer cylinders is that they may be too big to fit through available spaces in printing presses. Each partial shell 12 and 14 may be only about one-half as wide as a full cylinder and will fit through the available spaces without removal of structural cross members. Likewise, the hubs 30, 32 themselves and especially the hub halves are small enough to fit through the available spaces. Therefore the multiple part cylinder of the present invention is more easily installed into, and removed from, a press without removal of structural members.

The initial installation of a cylinder 10 begins with the installation of the hubs 30 and 32 as shown in FIG. 3. Assembly begins by placing two half-hub sections, e.g. 86, 88, on opposite sides of a press shaft and attaching them with the screws 50. In one assembly method, a spacer is used to position a first hub 30 or 32 a preselected distance from one end of the shaft 34 or a sprocket wheel attached to the shaft. The first hub 30 or 32 may then be tightened into position on the shaft 34 to prevent movement. In a preferred form, tightening includes use of a setscrew 98. A second hub 30 or 32 is then assembled in the same way on the shaft 34. Spacing between hubs 30, 32 may be determined with a spacer rod or tool used only for installation. Alternatively, the proper spacing may be set by installing a partial shell 14 on the hubs 30, 32. If necessary, the setscrews 98 may be loosened on one or both hubs for repositioning. Once both hubs 30, 32 are in proper position, the setscrews 98 may be firmly tightened against the shaft 34 to prevent further movement of the hubs 30, 32.

Once the hubs 30, 32 are properly positioned, the partial shells 12, 14 may be easily and quickly snapped onto and released from the hubs without use of tools. Manual pressing of the push buttons 56, or pulling of latches 52, releases the partial shells 12, 14. Pressing the partial shells onto the hubs 30, 32 reattaches them.

The multiple part cylinder system of the present invention has advantages other than quick and simple installation in, and removal from, a press. A large variety of cylinder sizes may be made with identically dimensioned profiles on the hubs 30, 32 and the cylinder frames 22, 24, 26 and 28. Once the hubs are in place on a press shaft, cylinders of different outer diameters or contours can quickly be installed and removed. Printing press shafts, e.g. shaft 34, are made in a variety of diameters. The hubs 30, 32 may be manufactured with bores 94, 96 sized to fit the smallest of the standard shafts 34. If hubs are needed for a larger shaft, the bore may be drilled to fit the larger size.

Various printing presses require cylinders having different outer diameters. The cylinder frames may be made initially to provide a larger cylinder diameter, e.g. seven inches, but may be easily turned down to smaller diameter, e.g. six inches. As noted above, in various presses it is desired that the cylinders not have a true cylinder shape. They may instead be eccentric, have a false radius, or may have different radii at the gripper and tail edges. The cylinder frames 22, 24, 26 and 28 determine the outer contour of the transfer cylinder 10. Therefore, initially manufacturing the frames 22, 24, 26 and 28 with a large outer diameter allows them to be machined to any desired outer contour within preselected ranges. The cylinder frames do not directly engage the printing press shaft. The cylinder frame profiles engage the hub profiles instead. As a result, there is no need to change or adjust the inner dimensions of the partial shell frames to accommodate various sized printer shafts. Only the hub bores must be sized according to the particular press shaft size.

Since the outer surfaces of the cylinders 10 may be made of sheet material, e.g. aluminum, which is cut to size and bent into the generally cylindrical shape with gripper and tail flanges, it is only necessary to stock a few sizes of sheet material which can be cut to size when a cylinder is made. Thus, the present invention also provides significant advantages in the number of different parts which need to be kept in inventory in order to make a variety of sizes of transfer cylinders. Manufacturing costs are reduced because the common parts may be ordered in large batches since they can be used to make the large number of different cylinders.

The present invention was initially developed to address problems recognized in use of small offset printing presses which typically print on substrates having widths of from about five inches up to about fourteen inches, and print in only one or two colors. Such small presses are being improved to print in more colors and/or to provide coatings which requires more transfer cylinders. These presses typically use transfer cylinders having diameters in the range of six to seven inches. These small presses are particularly affected by the problem of structural members blocking full access to transfer cylinders. While developing the present invention, it was realized that several features of the present invention also provide significant advantages in larger presses even if there are no access problems. For example, it may be just as desirable to remove transfer cylinders for cleaning the transfer cylinders themselves or for easier access to other cylinders. It may also be desirable to change transfer cylinder diameters or contours for different types of printing processes or substrates. The present invention allows cylinders to be removed and replaced quickly saving valuable production time. In addition, the commonality of parts used in making the cylinders is expected to reduce manufacturing cost enough so that the improved cylinders can be sold at a lower price than one-piece cylinders currently in use. As a result, it is expected that the cylinder of the present invention will be scaled up to sizes such as forty-inch width and ten-inch diameter. In that case, the basic parts, i.e. the hubs and/or cylinder frames may be made in two or more sizes, each intended for a given range of shaft and cylinder diameters.

The above description of a first embodiment illustrates the basic elements of the present invention, which include a hub having a profile for receiving a partial shell, a partial shell having a profile matching the hub profile and a latch for holding the hub and partial shell profiles in engagement. FIGS. 7 through 10 illustrate a second embodiment in which alternative profiles and latch mechanisms are used.

Figure 7:
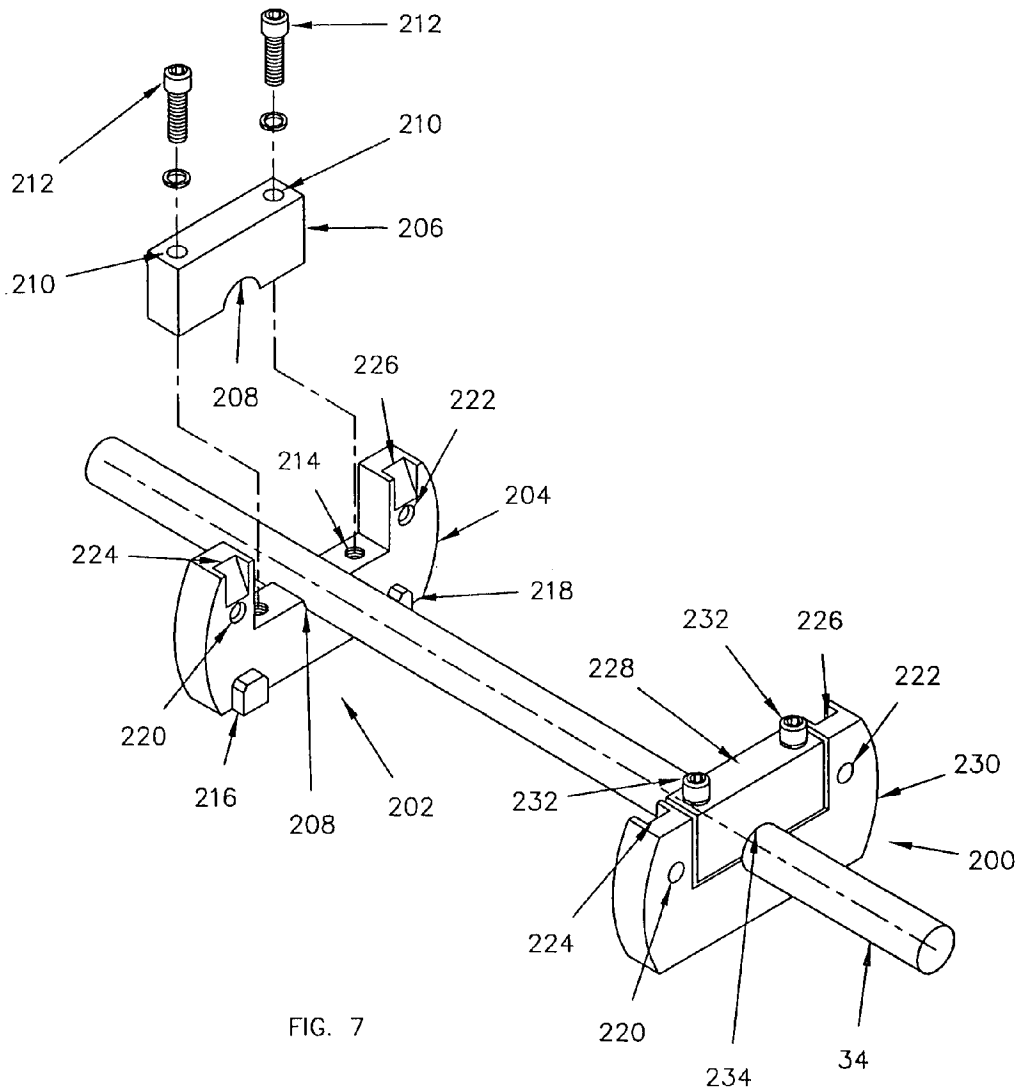
FIG. 7 is a perspective view of one cylinder hub of a second embodiment installed on a press shaft and an exploded view of a second cylinder hub illustrating installation of the cylinder hubs on a press shaft.

FIG. 7 illustrates a pair of alternative hubs 200 and 202 for a second embodiment which may be installed on the printing press shaft 34. Hub 202 is shown in an exploded view illustrating its method of attachment to the shaft 34. The Hub 202 includes a generally U shaped lower part 204 and a rectangular upper part 206 sized to fit within the lower part 204. A central bore 208 sized to fit the shaft 34 is formed half in the upper part 204 and half in the lower part 206. The upper part 206 has a pair of clearance holes 210 for receiving a pair of bolts or screws 212. The lower part 204 has a pair of threaded holes 214 into which the screws 212 may be fastened to connect the upper part 206 to the lower part 204 and connect the completed hub 202 to the shaft 34. These portions of the hub 202 are structurally and functionally very similar to the upper and lower parts 86, 88 of the hub 30 in FIG. 3.

The hub 202 includes profiles for receiving a pair of partial shells. The profiles include a pair of lugs 216 and 218 carried on a side of the lower part 204. In this embodiment, the lug 216 is wider than the lug 218. The lugs 216, 218 in this embodiment may be machined from the same piece of material, e.g. aluminum, as the lower part 204. It may be desirable, e.g. to reduce the amount of metal removed during machining, to replace the lugs 216, 218 with steel pins press fit into holes in the lower part 204 or cap screws screwed into threaded holes in the lower part 204. The profiles also include a pair of holes 220 and 222 extending through the lower part 204 and aligned parallel to the shaft 34. A pair of slanted surfaces 224 and 226 are provided above the holes 220 and 222.

The hub 200 is essentially a mirror image of the hub 202 and is shown with its upper part 228 and lower part 230 connected by a pair of screws 232. The hub 200 has a central bore 234 receiving the shaft 34.

As in the first embodiment, the central bores 208 and 234 may form an interference fit on shaft 34 or may form a frictional fit which allows some movement after the screws 212 and 232 are tightened. If the fit is frictional, setscrews may be provided as shown in the first embodiment for preventing rotation of the hubs 200 and 202 relative to the shaft 34. In this second embodiment, it may be desirable for both hubs 200 and 202 to have interference fits since the screws 212 or 232 may be tightened after installation of one or both partial shells.

Figure 8:
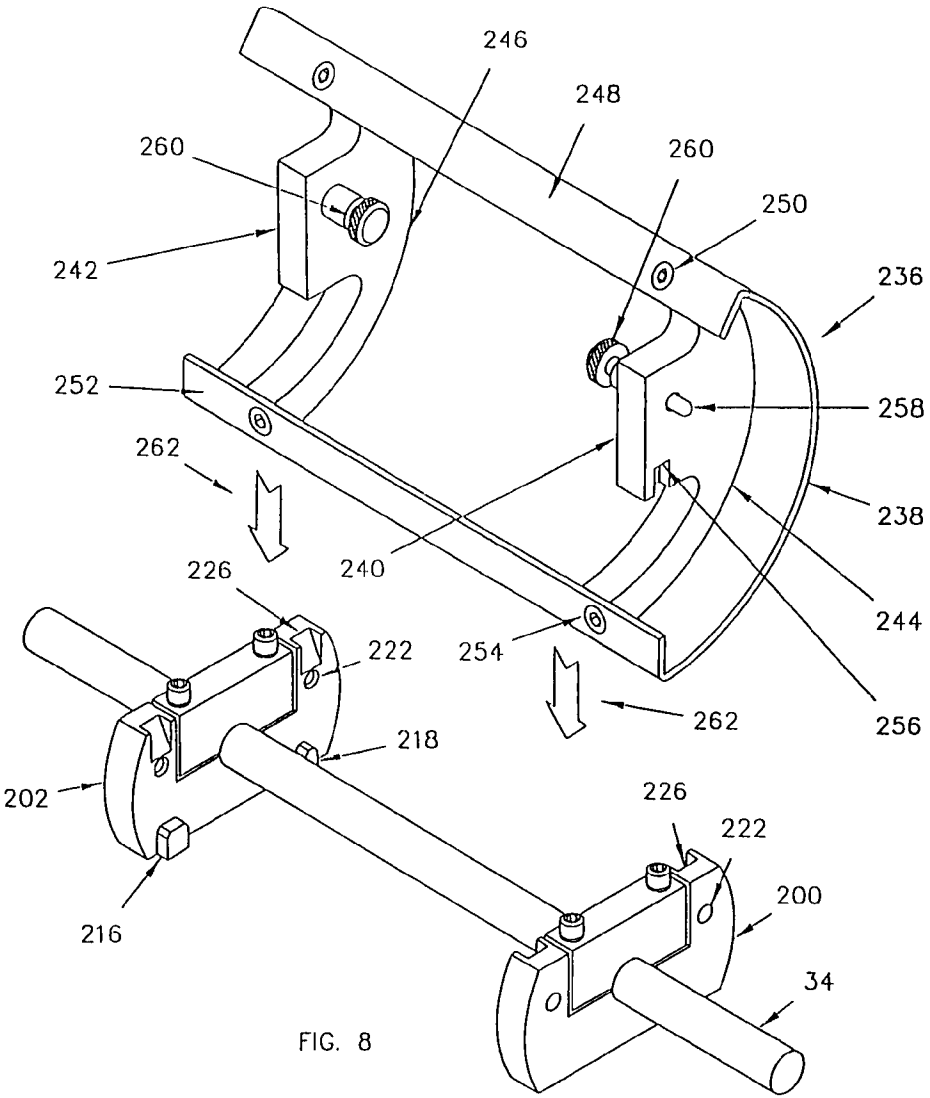
FIG. 8 is an illustration of a first partial shell of a second embodiment and a method of assembly of the first partial shell of the second embodiment to hubs on a printing press shaft.

FIG. 8 illustrates one partial shell 236 of the second embodiment and a method of installation of the partial shell 236 onto hubs 200 and 202. The partial shell 236 includes an outer sheet metal skin or surface 238 which may be identical to the surface 18 of the partial shell 14 of FIG. 1. The partial shell 236 also includes a pair of cylinder frames 240 and 242 having outer circumferences 244 and 246 which may be shaped like the outer circumferences 23 and 25 of frames 22 and 24 of the partial shell 14. The outer surface 238 includes a flange 248 connected to the frames 240, 242 with screws 250, and a flange 252 connected to the frames 240, 242 by jack screws 254 in the same manner as described above for the first embodiment. Thus, the portions of the partial shell 236 thus far described may be essentially identical to corresponding portions of the first embodiment.

The cylinder frames 240 and 242 have profiles and latches for releasable attachment to the hubs 200 and 202. Slots 256 are provided on the lower outer sides of the cylinder frames 240, 242, with only the slot 256 in frame 240 being visible in FIG. 8. The slots 256 are sized to mate with, i.e. slide onto, the lugs 218 on the hubs 200 and 202. A pair of spring loaded pins 258 extend from the upper outer surfaces of the frames 240 and 242 and are positioned to engage the holes 222 in the hubs 200 and 202 when the slots 256 have engaged the lugs 218. Each pin 258 has a handle, e.g. a thumb nut, plunger assembly, spring assembly, etc., 260 affixed to an end extending from the inner upper surfaces of the frames 240, 242.

Figure 9:
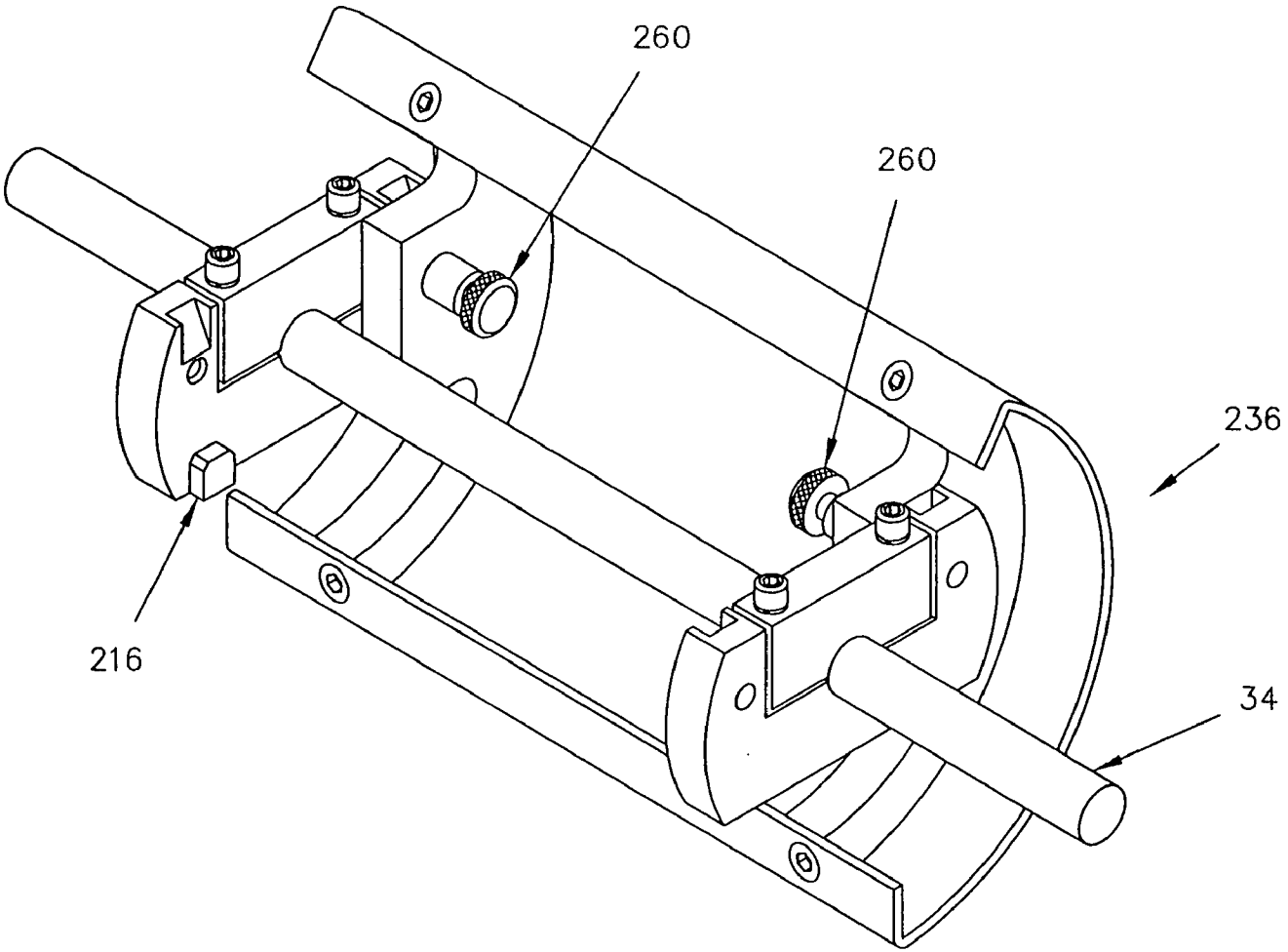
FIG. 9 is an illustration of the first partial shell of the second embodiment installed on hubs on a printing press shaft.

As indicated by the arrows 262, the partial shell 236 may be installed onto the hubs 200, 202 by lowering the partial shell 236 so that the slots 256 slide over the lugs 218. At the same time, the pins 258 may be aligned with the slanted surfaces 226, so that the pins 258 are forced back into the frames 240 and 242 as the partial shell is lowered. When the pins 258 are brought into alignment with the holes, the pins 258 snap into the holes 222. The installed position of the partial shell 236 is illustrated in FIG. 9. In this embodiment, the pins 258 and holes 222 act as both a part of the profiles which properly align a partial shell with a hub, but also act as a latch for holding the partial shell and hub together. The partial shell 236 may be removed from the hubs 200, 202 by manually gripping the handles 260 and pulling the pins 258 out of holes 222 and then lifting the partial shell 236 away from the hubs.

Figure 10:
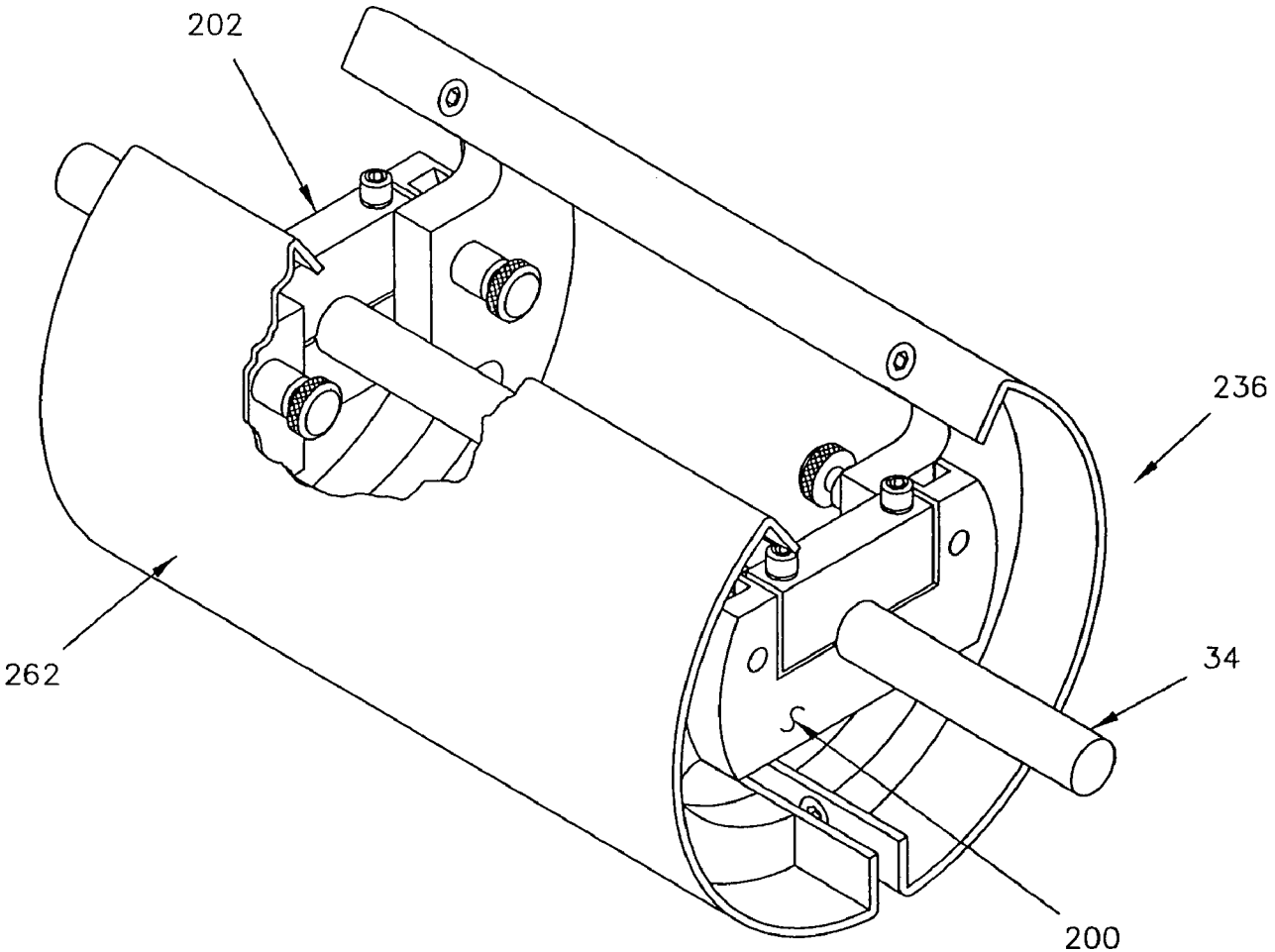
FIG. 10 is a perspective view of a second partial shell of the second embodiment and a complete cylinder of the second embodiment assembled on a printing press shaft.

FIG. 10 illustrates a partially broken away view of a completed cylinder of the second embodiment in which a second partial shell 262 has been assembled onto the hubs 200, 222. The partial shell 262 may be an exact mirror image of the partial shell 236, and may be attached and removed from the hubs 200, 222 in the same way. In this embodiment, the lugs 216 on the hubs 200, 222 are wider than the lugs 218. As a result, the slots in the cylinder frames of partial shell 262 are wider than the slots 256 in the cylinder frames 240, 242 of the partial shell 236. The size difference in these profile elements restricts the installation of the partial shells so that they may be installed only in one orientation on the hubs 200, 202.

The method of installation of a cylinder covering as shown in FIG. 6, applies equally well to the second embodiment. It is understood that releasable attachment strips, like the strips 40 shown in FIG. 1, may be attached to flanges 248 and 252 of the partial shell 236 of FIG. 8 and corresponding flanges on partial shell 262 of FIG. 10 for attachment of cylinder coverings as described with reference to FIG. 6. The other advantages of the first embodiment discussed above, e.g. interchangability of cylinders, commonality of part, etc., apply equally well to the second embodiment.

The second embodiment may have some functional advantages as compared to the first embodiment. The partial shells 236, 262 mechanically engage only one portion, i.e. the U shaped lower portion, of each of the split hubs 200, 202. In the first embodiment, the partial shell profiles engage both halves of each split hub and may restrict loosening the hubs for repositioning on the shaft 34 once a partial shell has been installed on a hub with an interference fit on the shaft 34. In the second embodiment, the screws 212, 232 may be loosened after one or both half hubs have been installed and the hubs 200, 202 may be repositioned and then retightened. As a result, both hubs 200, 202 may have interference fit central bores and setscrews may not provide any advantage.

In the second embodiment, separate latches are provided for connecting each partial shell to the hubs 200, 202. In the first embodiment, pressing the push buttons 56 releases both partial shells at the same time. In the first embodiment, the latch is opened during installation of the second partial shell which may release the first installed partial shell as the second partial shell is installed. In the second embodiment, the use of separate latches eliminates any chance of undesired release of the first installed partial shell as the second partial shell is installed.

The descriptions above illustrate alternative structures which may be used in various embodiments of the present invention. For example, profiles for positioning partial shells relative to hubs may be formed on outer circumferences of hubs and inner circumferences of cylinder frames, or may be formed on side surfaces of hubs and cylinder frames. In either case, a profile is a shaped surface on a hub or a shell which allows a shell to be mounted on and mated with a hub in a preselected position relative to the hub and therefore relative to a press shaft. A latch is any device which holds a shell in position on a hub when a shell profile is mated with a hub profile. Latches may have moving parts on either the hubs or the cylinder frames. A single moving latch part may connect both partial shells or separate latches may be provided for each partial shell. A latch mechanism may be separate from the profiles as in the first embodiment, or may also be part of the profile as in the second embodiment.

In the above-described embodiments, each multiple part cylinder comprises two hubs and two partial shells. Each partial shell provides somewhat less that 180 degrees of a cylindrical surface when the separations 20 and 21 are taken into account. In some cases, e.g. very long or large diameter cylinders, it may be desirable to divide the cylinder into more parts by for example having three partial shells, each providing somewhat less than 120 degrees of a cylindrical surface. A third profile may be provided on each hub for receiving a third partial shell. Each partial shell would then have a smaller cross section and would be lighter and may further facilitate the easy installation and removal of the multiple part cylinder.

Since a press cylinder according to the present invention comprises several parts which may be assembled by the end user, it is particularly suited for delivery in kit form. For a new installation, i.e. either a new press or an old press from which a prior art cylinder has been removed, a kit may contain two hubs and two partial shells. The end user may then attach the hubs to a press shaft as described above and then snap on a first and then a second partial shell.

In many cases a kit may contain a third and a fourth partial cylinder having mounting profiles for mating with the same pair of hubs. But the third and fourth partial cylinders may have outer circumferences shaped differently from the first and second partial shells. Each outer shape may be suitable for printing on a different type of substrate or a different printing process. Once the hubs are installed on the press, the end user may quickly switch from one cylinder outer shape to the other as he finishes one printing job and starts a different printing job.

If a printing press already includes a cylinder according to the present invention, a kit may comprise two partial cylinders. The two partial cylinders may be replacements for an original pair of partial cylinders which has been damaged and thus may be essentially identical to an originally installed pair. Alternatively, the two partial cylinders may have an outer diameter or contour different from the original partial cylinders. The end user may need to change the cylinder shape to print on different substrates or to use different printing processes. Once hubs are installed, the end user need only purchase a partial cylinder kit having the outer size and shape he needs for his new printing jobs. The end use may then open the latches to remove the first and second original partial cylinders and snap the new third and fourth partial cylinders onto the hubs as described above.

While the present invention has been illustrated and described in terms of specific structures and methods of making and use, it is apparent that various changes therein and substitutions of structures and methods may be made within the scope of the invention as defined by the appended claims.

What we claim as our invention is:

1. A printing press cylinder, comprising:

a first hub having a bore for engaging a printing press shaft and having a first profile for engaging a first partial shell, a second hub having a bore for engaging a printing press shaft and having a first profile for engaging a first partial shell, a first partial shell having a first pair of profiles adapted for engaging the first profiles on each of the first and second hubs; and a latch releasably attaching the first partial shell to at least one of the first and second hubs when the first partial shell first pair of profiles are engaged with the first profiles on each of the first and second hubs.

2. A printing press cylinder according to claim 1, wherein each of the first and second hubs comprises an upper hub section and a lower hub section, and half of the bore is formed in each of the upper hub section and the lower hub section.

3. A printing press cylinder according to claim 2, further comprising clearance holes in each upper hub section, threaded holes in each lower hub section, and threaded fasteners positioned through the clearance holes and threaded into the threaded holes.

4. A printing press cylinder according to claim 1, wherein the latch comprises a moving part carried on at least one of the first and second hubs.

5. A printing press cylinder according to claim 4, wherein the latch comprises a spring urging the moving part into the latched position.

6. A printing press cylinder according to claim 1, wherein the latch comprises a moving part carried on the first partial shell.

7. A printing press cylinder according to claim 6, wherein the latch comprises a spring urging the moving part into the latched position.

8. A printing press cylinder according to claim 1, wherein the latch is manually releasable.

9. A printing press cylinder according to claim 1, further comprising:

on the first hub, a second profile for engaging a second partial shell, on the second hub, a second profile for engaging a second partial shell, and a second partial shell having a second pair of profiles adapted for engaging the second profiles on each of the first and second hubs.

10. A printing press cylinder according to claim 9, wherein the first and second profiles on each of the first and second hubs have different shapes, the first partial shell first pair of profiles are adapted for engaging the first profiles on each of the hubs, and the second partial shell second pair of profiles are adapted for engaging the second profiles on each of the hubs.

11. A printing press cylinder according to claim 9, wherein the first and second profiles on each of the first and second hubs have the same shape, the first partial shell first pair of profiles are adapted for engaging both the first and second profiles on each of the hubs, and the second partial shell second pair of profiles are adapted for engaging both the first and second profiles on each of the hubs.

12. A printing press cylinder, comprising:

a first hub having a bore for engaging a printing press shaft and having a first profile for engaging a first partial shell, a second hub having a bore for engaging a printing press shaft and having a first profile for engaging a first partial shell, a first partial shell having a first pair of profiles adapted for engaging the first profiles on each of the first and second hubs on the first hub, a second profile for engaging a second partial shell, on the second hub, a second profile for engaging a second partial shell, and a second partial shell having a second pair of profiles adapted for engaging the second profiles on each of the first and second hubs, wherein the first and second partial shells define an outer contour having a false radius.

13. A printing press cylinder, comprising:

a first hub having a bore for engaging a printing press shaft and having a first profile for engaging a first partial shell, a second hub having a bore for engaging a printing press shaft and having a first profile for engaging a first partial shell, a first partial shell having a first pair of profiles adapted for engaging the first profiles on each of the first and second hubs, on the first hub, a second profile for engaging a second partial shell, on the second hub, a second profile for engaging a second partial shell, and a second partial shell having a second pair of profiles adapted for engaging the second profiles on each of the first and second hubs, and a latch releasably attaching the second partial shell to at least one of the first and second hubs when the second partial shell second pair of profiles are engaged with the second profiles on each of the first and second hubs.

14. A printing press cylinder according to claim 13, wherein the latch comprises a moving part carried on at least one of the first and second hubs.

15. A printing press cylinder according to claim 14, wherein the latch comprises a spring urging the moving part into the latched position.

16. A printing press cylinder according to claim 13, wherein the latch comprises a moving part carried on the second partial shell.

17. A printing press cylinder according to claim 16, wherein the latch comprises a spring urging the moving part into the latched position.

18. A printing press cylinder according to claim 13, wherein the latch is manually releasable.

19. A printing press cylinder, comprising:

a first hub having a bore for engaging a printing press shaft and having a first profile for engaging a first partial shell, a second hub having a bore for engaging a printing press shaft and having a first profile for engaging a first partial shell, a first partial shell having a first pair of profiles adapted for engaging the first profiles on each of the first and second hubs on the first hub, a second profile for engaging a second partial shell, on the second hub, a second profile for engaging a second partial shell, and a second partial shell having a second pair of profiles adapted for engaging the second profiles on each of the first and second hubs, wherein the first and second partial shells define an eccentric outer contour.

20. A printing press cylinder, comprising:

a first hub having a bore for engaging a printing press shaft and having a first profile for engaging a first partial shell, a second hub having a bore for engaging a printing press shaft and having a first profile for engaging a first partial shell, a first partial shell having a first pair of profiles adapted for engaging the first profiles on each of the first and second hubs on the first hub, a second profile for engaging a second partial shell, on the second hub, a second profile for engaging a second partial shell, and a second partial shell having a second pair of profiles adapted for engaging the second profiles on each of the first and second hubs, wherein the first and second partial shells define a cylindrical outer contour.

* * * * *